US009058752B2

(12) United States Patent
Ganster et al.

(10) Patent No.: US 9,058,752 B2
(45) Date of Patent: Jun. 16, 2015

(54) FLEX MOUNT TERMINAL MARKER

(71) Applicant: Panduit Corp., Tinley Park, IL (US)

(72) Inventors: Zachary Scott Ganster, Canton, GA (US); Jennifer Lynn Schwert, Atlanta, GA (US); Michael Scott Adams, Cumming, GA (US); David Scott Morrison, Cumming, GA (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 14/511,646

(22) Filed: Oct. 10, 2014

(65) Prior Publication Data

US 2015/0040447 A1 Feb. 12, 2015

Related U.S. Application Data

(63) Continuation-in-part of application No. 13/611,155, filed on Sep. 12, 2012, now Pat. No. 8,857,086.

(51) Int. Cl.

| | |
|---|---|
| ***G09F 1/10*** | (2006.01) |
| ***G09F 3/02*** | (2006.01) |
| ***G09F 3/04*** | (2006.01) |

(52) U.S. Cl.

CPC ... *G09F 3/02* (2013.01); *G09F 3/04* (2013.01)

(58) Field of Classification Search

CPC ..... G09F 1/10; G09F 3/20; G09F 3/16; G09F 3/204

See application file for complete search history.

(56) References Cited

U.S. PATENT DOCUMENTS

| | | | |
|---|---|---|---|
| 1,996,664 | A | 4/1935 | Walker |
| 2,746,189 | A | 5/1956 | Bass |
| 3,921,798 | A | 11/1975 | Dean et al. |
| 4,253,629 | A | 3/1981 | Wilmes |
| 4,258,487 | A | 3/1981 | Hohorst |
| 4,539,766 | A | 9/1985 | Fast |
| 4,637,676 | A | 1/1987 | Simonsen et al. |
| 4,649,658 | A | 3/1987 | Sarton et al. |
| 5,080,607 | A | 1/1992 | Cristescu |
| 5,338,224 | A | 8/1994 | Blanke et al. |
| 5,579,907 | A | 12/1996 | Kedski |

(Continued)

FOREIGN PATENT DOCUMENTS

| | | |
|---|---|---|
| DE | 1857546 U | 8/1962 |
| DE | 8404741 U1 | 10/1985 |

(Continued)

OTHER PUBLICATIONS

Wago® Innovative Connections, WMB Multi Marking System Data Sheet, 2 pages, Mar. 21, 2012.

(Continued)

*Primary Examiner* — Casandra Davis

(74) *Attorney, Agent, or Firm* — Christopher S. Clancy; Aimee E. McVady

(57) ABSTRACT

The present invention is directed toward a terminal marker used to identify a terminal block. The terminal marker includes a front having a print surface, a back, sides, and flexible legs. The flexible legs can be positioned in a natural state for installation in the terminal block or a compressed state for obtaining a marking from a printer. In the natural state, the flexible legs extend at an angle with respect to the print surface of the terminal marker. In the compressed state, the flexible legs extend outward beyond of the sides of the terminal marker.

11 Claims, 23 Drawing Sheets

(56) References Cited

U.S. PATENT DOCUMENTS

| | | | | |
|---|---|---|---|---|
| 5,613,874 | A | 3/1997 | Orlando et al. | |
| 5,638,624 | A | 6/1997 | Cornu | |
| 5,700,986 | A | 12/1997 | Rürup et al. | |
| 5,741,153 | A | 4/1998 | Schwer | |
| 5,896,826 | A | 4/1999 | Winer | |
| 6,298,526 | B1 | 10/2001 | Baumdicker et al. | |
| 6,700,782 | B1 * | 3/2004 | Bopp et al. | 361/704 |
| 6,793,524 | B2 | 9/2004 | Clark et al. | |
| 7,740,282 | B2 | 6/2010 | McNutt et al. | |
| 7,963,056 | B1 | 6/2011 | Mangone, Jr. | |
| 8,488,134 | B2 | 7/2013 | Reibke | |
| 8,827,739 | B2 | 9/2014 | Hanses | |
| 2001/0039699 | A1 * | 11/2001 | McAllister | 24/536 |
| 2011/0005110 | A1 | 1/2011 | Wieneke | |
| 2011/0279841 | A1 | 11/2011 | Reibke | |

FOREIGN PATENT DOCUMENTS

| | | | |
|---|---|---|---|
| DE | 19747663 | A1 | 6/1998 |
| DE | 20303475 | U1 | 5/2003 |
| DE | 202004009980 | U1 | 12/2005 |
| EP | 0552413 | B1 | 6/1996 |
| EP | 2214267 | A1 | 8/2010 |
| FR | 2849291 | A1 | 6/2004 |

OTHER PUBLICATIONS

Phoenix Contact, KLM-1 Terminal Strip Markers, 3 pages, Jan. 22, 2010.

Wireland Marking Tags, http://us1.activepoint.com/Newark_2011/print.html?uid+1332365588290, 1 page, printed Mar. 21, 2012.

Weidmüller Terminal Marker Catalog Pages, 18 pages, date unknown.

* cited by examiner

FLEX MOUNT TERMINAL MARKER

CROSS-REFERENCE TO RELATED APPLICATIONS

This application is a continuation-in-part of U.S. Application Ser. No. 13/611,155, filed Sep. 12, 2014, which will issue as U.S. Pat. No. 8,857,086 on Oct. 14, 2014, the subject matter of which is hereby incorporated by reference in its entirety.

FIELD OF THE INVENTION

The present invention relates to terminal markers, and more particularly, to a terminal marker with legs that can be compressed when the terminal marker is fed through a roll-fed, thermal transfer printer.

BACKGROUND OF THE INVENTION

Terminal blocks have been labeled via adhesive backed labels that are affixed to the front surface of terminal blocks for identification. However, the surface of terminal blocks are irregular and inconsistent from block to block resulting in poor adhesion of these labels that are vulnerable to unintentional removable by inadvertent physical contact or adhesive deterioration over time leaving the terminal blocks unidentifiable.

FIGS. 1 and 1A illustrate the most common method used for identifying terminal blocks. The terminal block markers 60 are formed from a semi-rigid molded plastic material, such as ABS. The terminal markers 60 have mounting latches 64 that protrude from the back of the label surface 62. The mounting latches engage the openings 52 in a terminal block 50 to secure the terminal marker 60 to the terminal block 50. The terminal markers 60 are typically printed on demand using specialized printing systems designed specifically for terminal block markers or manufactured with pre-printed legends. These systems are discrete from other printing operations and typically require discrete software and operator training.

As a result, there exists a need for a terminal marker with the same mounting functionality customers desire while being printable in common roll fed thermal transfer printers using the same software used for standard labeling practices.

SUMMARY OF THE INVENTION

The present invention is directed toward a terminal marker used to identify a terminal block. The terminal marker includes a front having a print surface, a back, and sides. The terminal marker also includes flexible legs that are positioned in a natural installed state. The flexible legs of the terminal marker bend to the compressed state to accommodate printing, and thereafter return to the natural installed state. In the natural installed state, the flexible legs extend downward at an angle with respect to the print surface of the terminal marker. In the compressed state, the flexible legs extend outward from the sides of the terminal marker.

DETAILED DESCRIPTION

Figure 1A:
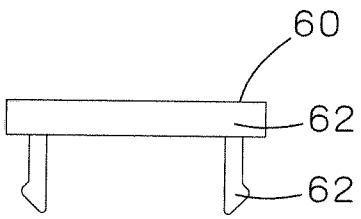
FIG.1A (Prior Art)
FIG. 1A is a front view of the prior art terminal marker of FIG. 1.
Figure 1:
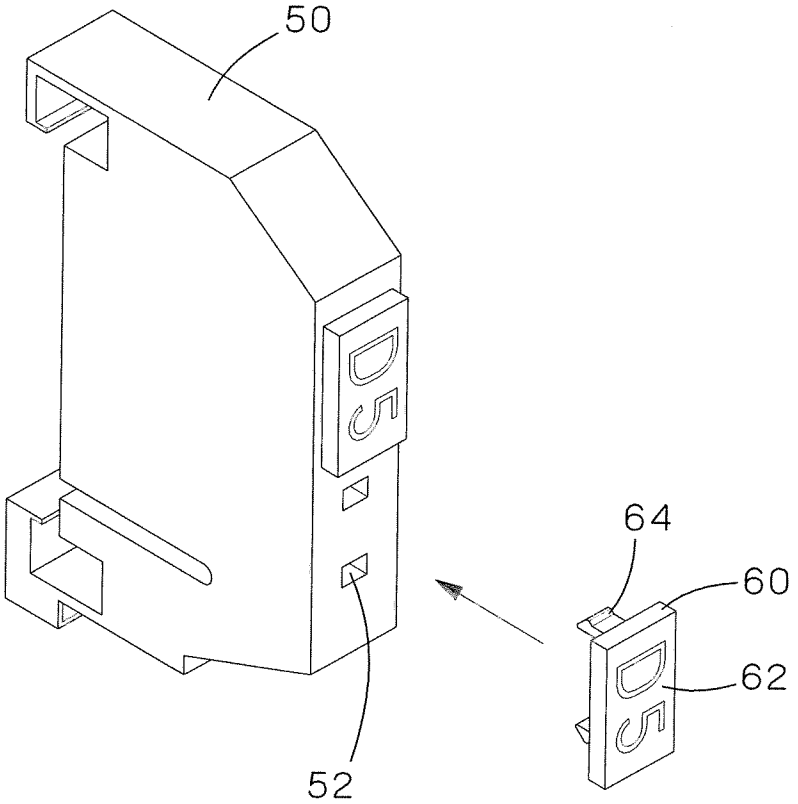
FIG.1 (Prior Art)
FIG. 1 is an exploded perspective view of a prior art terminal marker positioned to be installed in a terminal block.
Figure 2A:
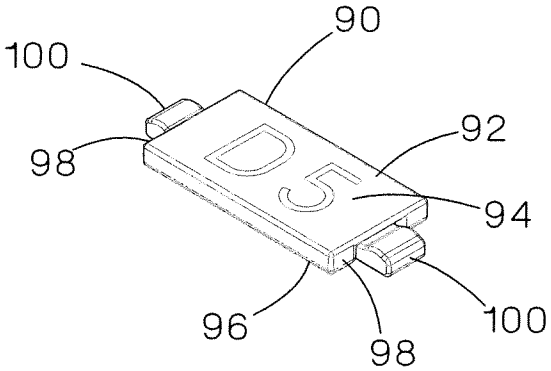
FIG. 2A is a top perspective view of the terminal marker of FIG. 2 in a compressed state.
Figure 2:
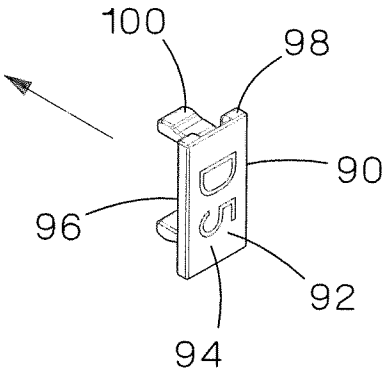
FIG. 2 is an exploded perspective view of a terminal marker of the present invention positioned to be installed in a terminal block.
Figure 2:
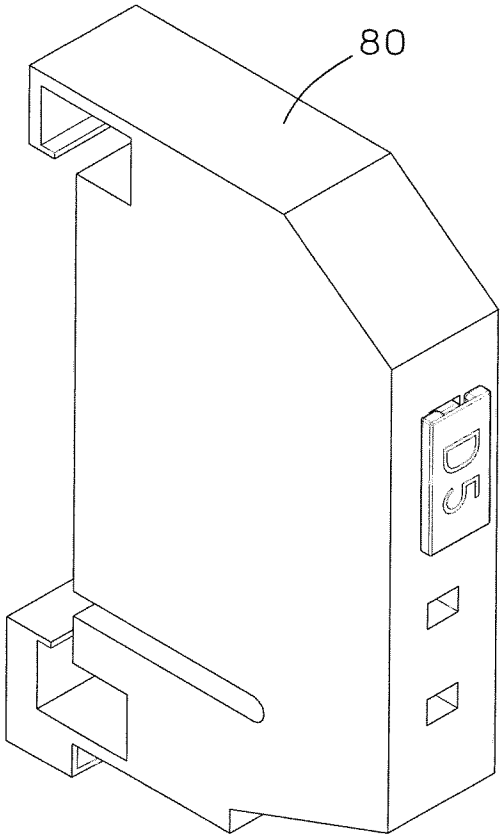
Figure 3C:
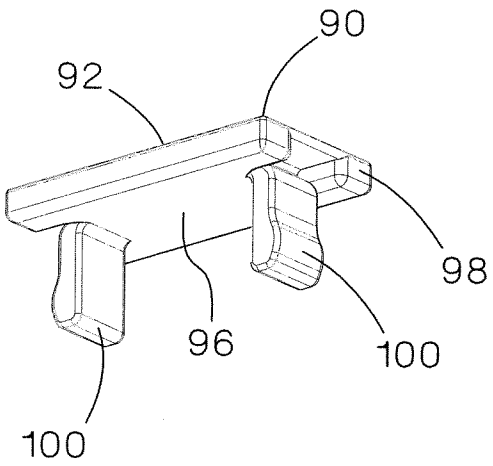
FIG. 3C is a bottom perspective view of the terminal marker of FIG. 3A.
Figure 3B:
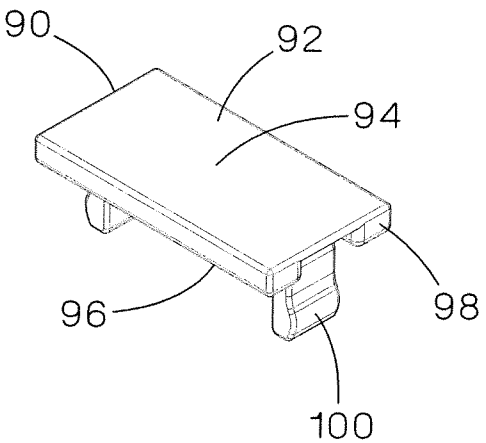
FIG. 3B is a top perspective view of the terminal marker of FIG. 3A.
Figure 3A:
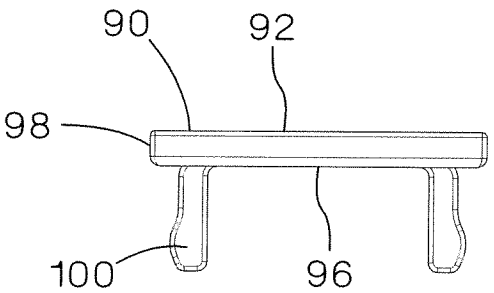
FIG. 3A is a front view of the terminal marker of FIG. 2 in an installed state.

FIGS. 2-8 illustrate the flexible terminal marker 90 of the present invention. FIG. 2 illustrates the terminal marker 90 positioned to be inserted in the terminal block 80. The terminal marker 90 includes a front 92, a back 96 and two legs 100. The front 92 has a print surface 94. The back 96 may include an adhesive, if desired. The legs 100 are formed to flex or bend downwards at each side 98 of the terminal marker 90. Extra material is added to the thickness of the terminal marker 90 on each side 98 of the legs 100 to ensure a uniform thickness when the terminal marker 90 is in the compressed state (see FIG. 2A and FIGS. 5A-C). The uniform thickness is imperative to ensure even print quality.

FIGS. 3A-C and FIG. 4 illustrate the terminal marker 90 in the installed or natural state with the legs 100 flexed downward. The legs 100 are positioned at an angle with respect to the print surface 94 on the front 92 of the terminal marker 90.

The terminal marker 90 is injection molded or extruded in the installed state. The terminal marker 90 is made from a material having elastic properties, such as thermoplastic polyurethane, to enable the legs 100 of the terminal marker 90 to bend and flex to a compressed state (see FIGS. 2A, 5A-C, and 6) for installation into a printer. The material of the terminal marker also provides memory properties in which the legs 100 of the terminal marker 90 return to the installed or natural state, without force or manipulation by the user.

Figure 5C:
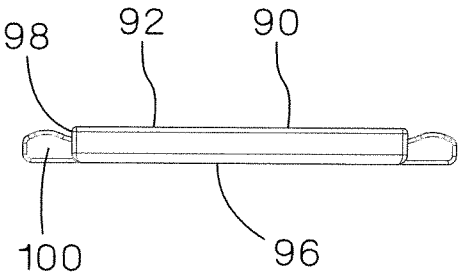
FIG. 5C is a front view of the terminal marker of FIG. 5A.
Figure 5B:
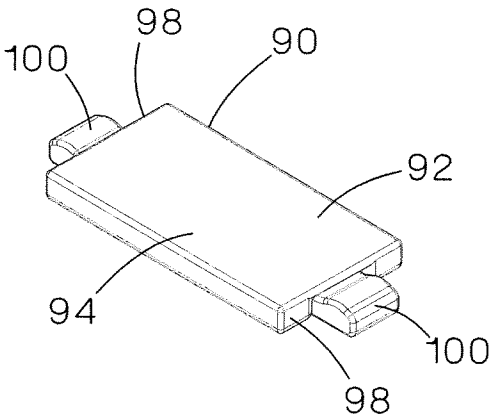
FIG. 5B is a top perspective view of the terminal marker of FIG. 5A.
Figure 5A:
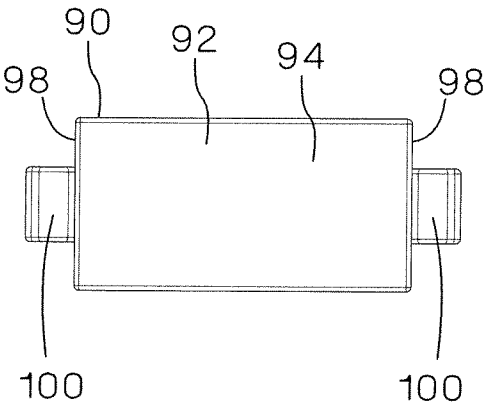
FIG. 5A is a top view of the terminal marker of FIG. 2 in a compressed state.

FIGS. 5A-C and FIG. 6 illustrate the terminal marker 90 in the compressed state. The terminal marker 90 of the present invention fits through a roll fed thermal transfer printer when the legs 100 are folded up or compressed into the terminal marker 90. The compressed terminal marker 90 creates an even print surface 94, as illustrated in FIGS. 5A-C.

Figure 4:
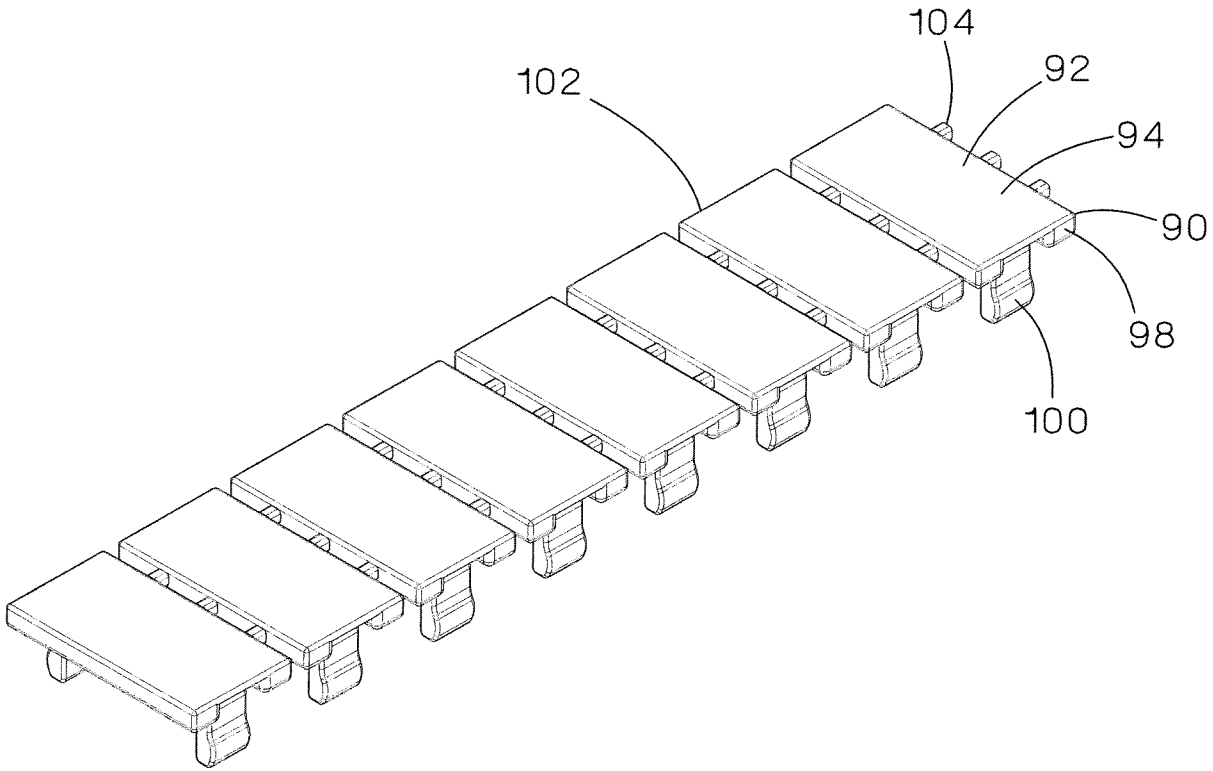
FIG. 4 is a top perspective view of a continuous strip of the terminal marker of FIG. 3A.
Figure 6:
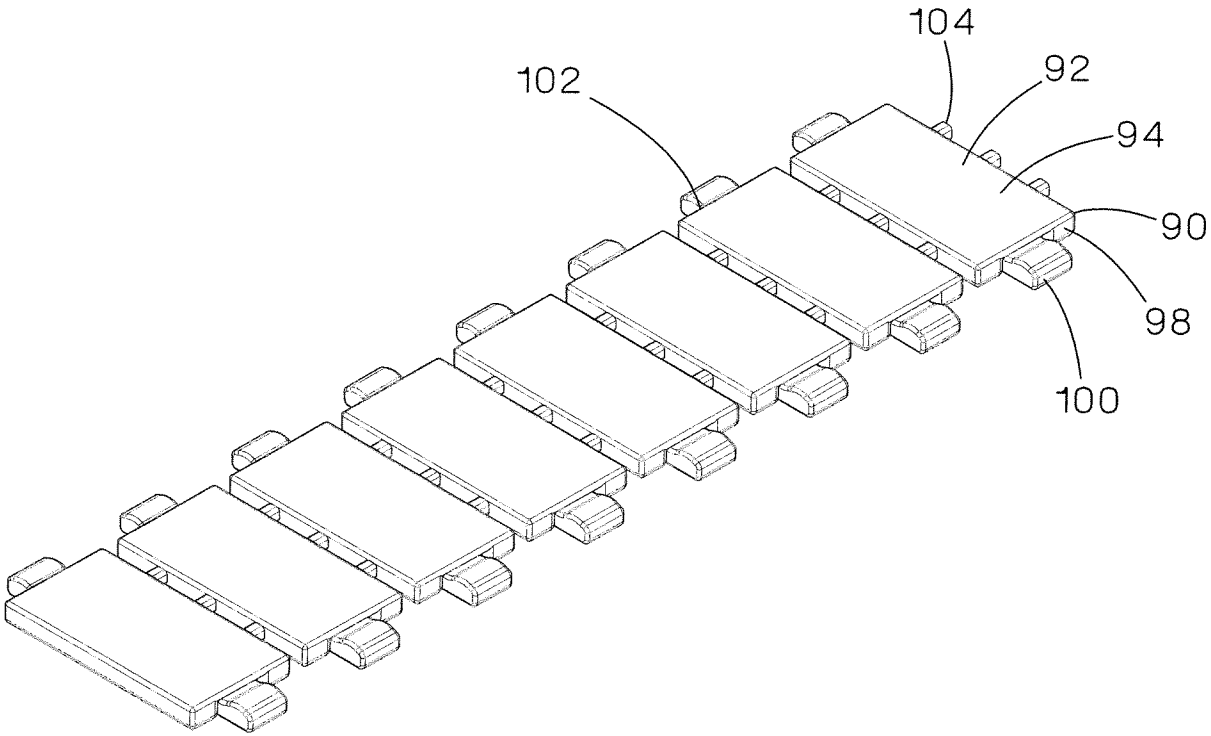
FIG. 6 is a top perspective view of a continuous strip of the terminal marker of FIG. 5A.

FIGS. 4 and 6 illustrate the terminal marker 90 in a continuous strip 102 with perforations 104 between each terminal marker 90. The legs 100 of the terminal markers 90 fold up into the compressed position (FIG. 6) when they encounter the nip roller of the printer and pass under the printhead in the compressed position. The terminal markers can be fed through a printer as a continuous strip or as a continuous roll.

Figure 8:
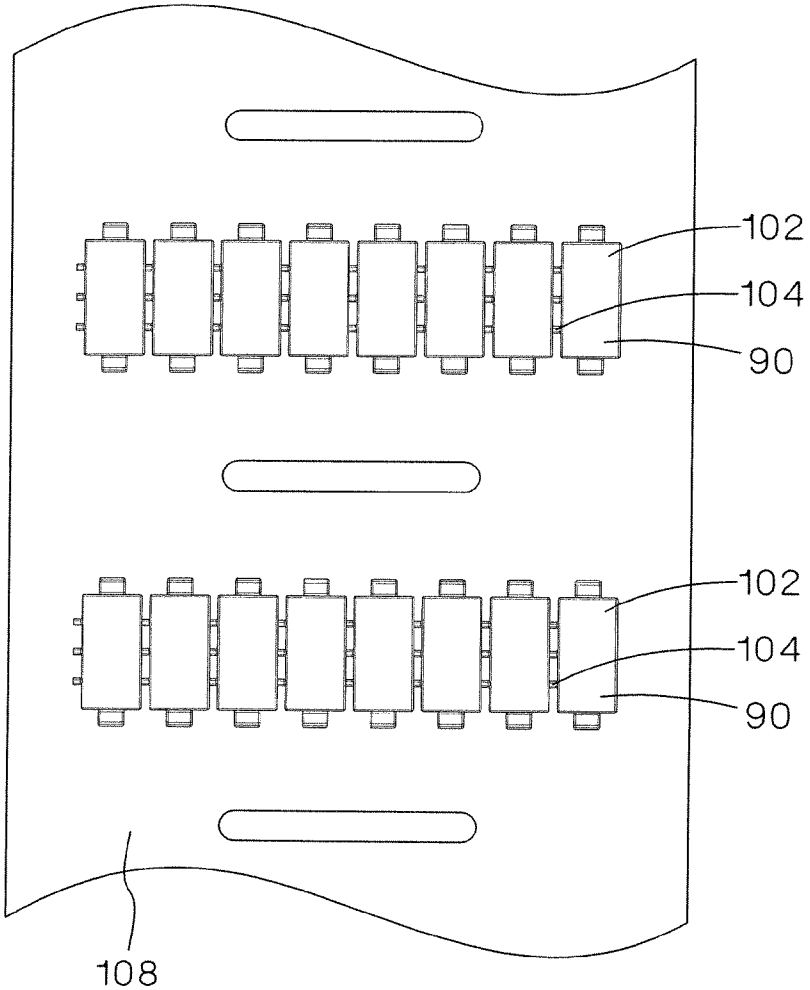
FIG. 8 is a top view of two continuous strips of FIG. 6 affixed to a liner.
Figure 7:
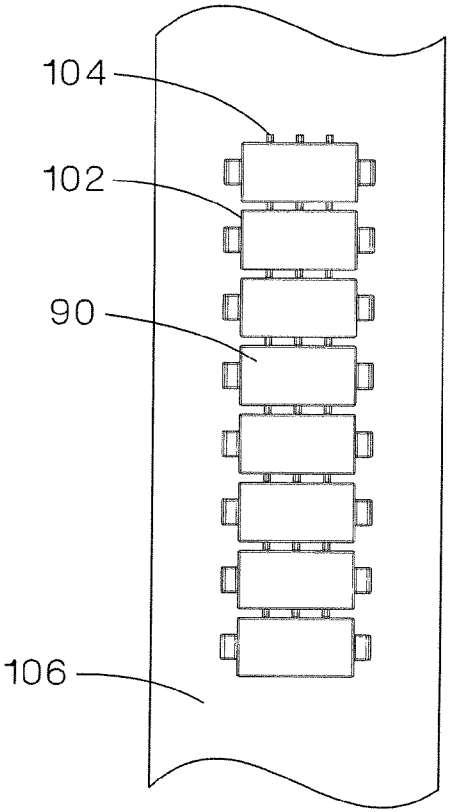
FIG. 7 is top view of the continuous strip of FIG. 6 affixed to a liner.
Figure 9A:
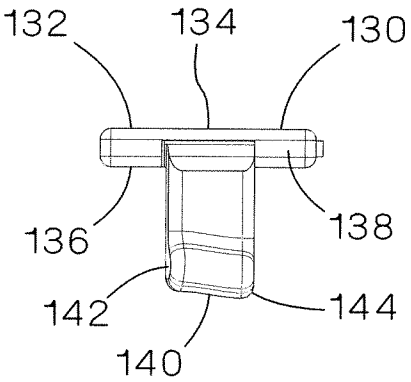
FIG. 9A is a side view of an alternative terminal marker of the present invention.
Figure 9B:
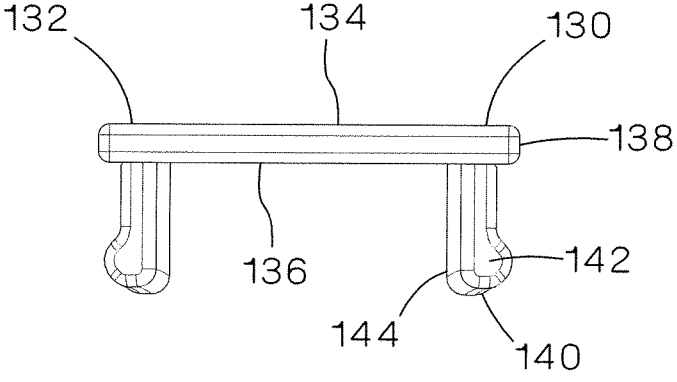
FIG. 9B is a front view of the terminal marker of FIG. 9A.
Figure 9C:
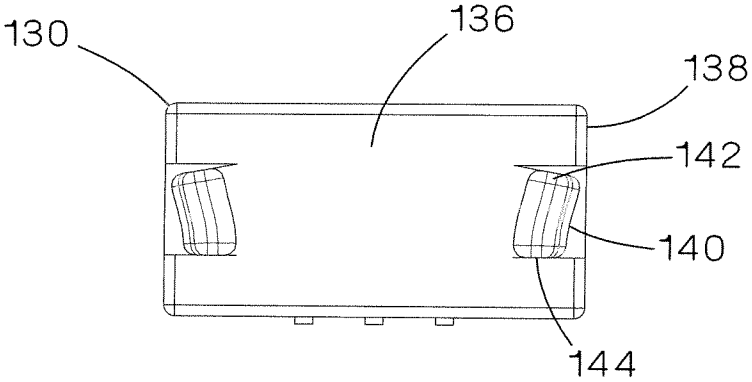
FIG. 9C is a bottom view of the terminal marker of FIG. 9A.
Figure 10:
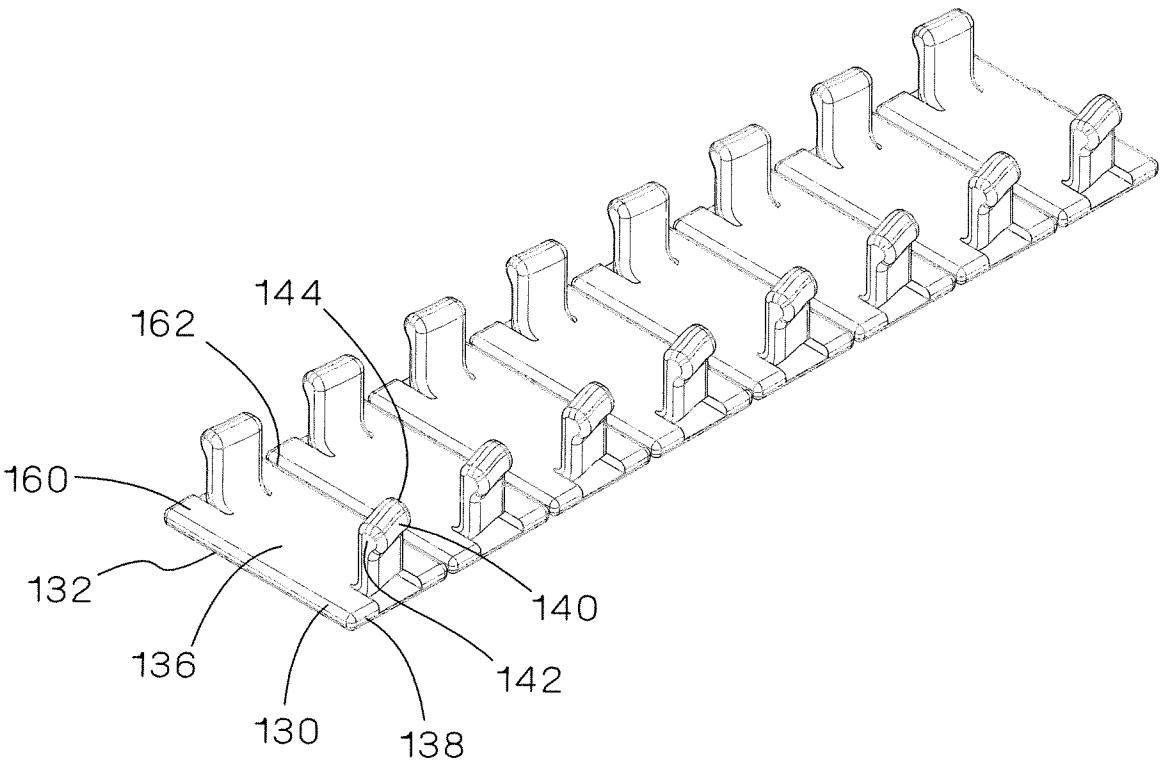
FIG. 10 is a bottom perspective view of a continuous strip of the terminal marker of FIG. 9A.

FIGS. 7 and 8 illustrate the continuous strip 102 of the terminal marker 90 affixed to various liners. To package the terminal markers 90 for optimal printer feeding, the terminal marker strips 102 can be affixed to a liner 106, 108 in the compressed state. The back 96 of the terminal markers 90 would include an adhesive to adhere the terminal markers 90 to the liner 106, 108 thereby forcing the legs 100 out to the side. After printing, the terminal marker 90 can be peeled from the liner 106, 108 and the properties of the terminal marker material will pull the legs 100 down to the proper angle of the installed state. The terminal markers 90 may be placed on the liner 106 in a continuous line similar to continuous heat shrink labels, as illustrated in FIG. 7. Alternatively, terminal marker strips 102 of a predetermined length may be placed on a liner 108 similar to die cut heat shrink labels, as illustrated in FIG. 8.

FIGS. 9A-C through FIG. 14A illustrate an alternative terminal marker 130 of the present invention. The alternative terminal marker 130 includes a front 132 with a print surface 134, a back 136, and legs 140 that flex downward from each side 138. The legs 140 include a front 142 and a back 144. As illustrated in FIGS. 9A-C and FIG. 10, the front 142 of each leg 140 is angled upwards. The front 142 of each leg is also wider and rotated out with respect to the back 144 of the leg 140. The angled and rotated front 142 of the legs 140 facilitates folding the legs 140 as it makes contact with the nip roller and is pulled under the printhead to enable the terminal marker 130 to advance through a printer.

Figure 11B:
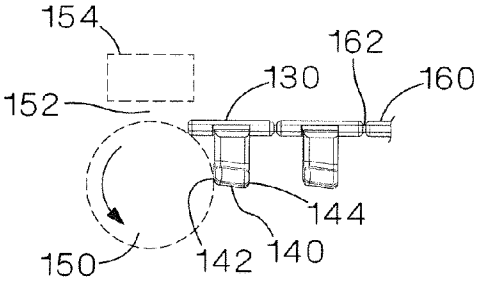
FIG. 11B is a side view of the continuous strip of the terminal marker and the print head assembly of FIG. 11A.
Figure 12B:
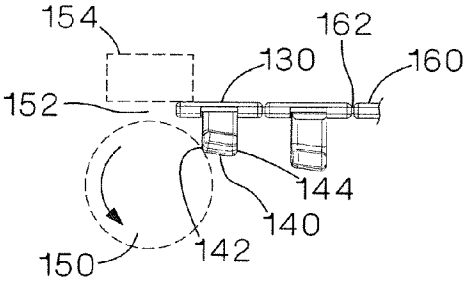
FIG. 12B is a side view of the print head assembly of FIG. 12A with the nip roller engaging the inside of the feet of the terminal marker.
Figure 13B:
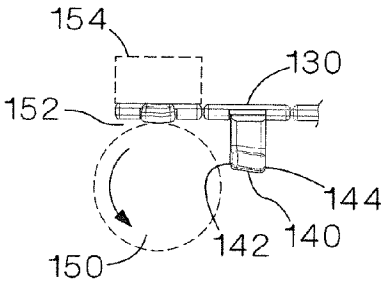
FIG. 13B is a side view of the print head assembly of FIG. 13A with the terminal marker positioned between the print head and the nip roller.
Figure 11A:
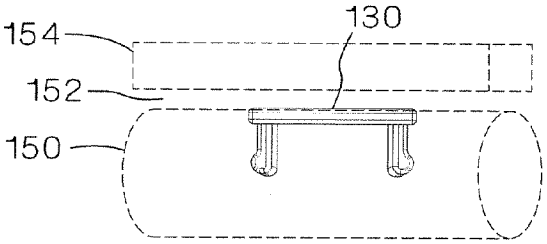
FIG. 11A is a front view of a continuous strip of the terminal marker of FIG. 9A positioned to be received by a print head assembly.
Figure 12A:
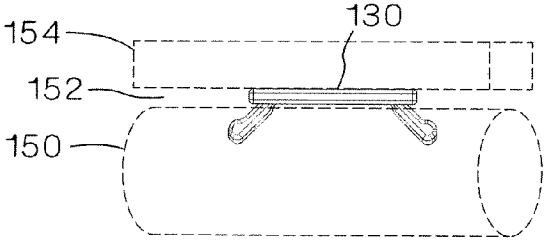
FIG. 12A is a front view of the print head assembly of FIG. 11A with the nip roller engaging the inside of the feet of the terminal marker.
Figure 13A:
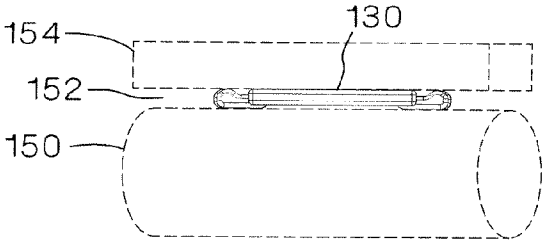
FIG. 13A is a front view of the print head assembly of FIG. 11A with the legs of the terminal marker compressed as the terminal marker is positioned in the print head assembly.

FIGS. 11A-B, 12A-B, and 13A-B illustrate the terminal marker 130 and a print head assembly as the print head assembly engages the terminal marker 130. The legs 140 are aligned to feed into the gap 152 between the nip roller 150 and the print head 154 (FIGS. 11A-B). The nip roller 150 engages the inside of the leg 140 (FIGS. 12A-B) and the rotation of the nip roller 150 opens and compresses the legs 140 as it pulls the terminal marker 130 into the gap 152 to be printed on (FIGS. 13A-13B). As a result, the terminal marker 130 provides a thin flat surface necessary for printing.

The terminal markers 130 can be fed through the printer in continuous strips 160 or as a continuous roll. The perforations 162 in between the terminal markers 130 enable easy removal of individual or small groups of terminal blocks, according to the customer's need. Alternatively, the terminal markers 130 can be affixed to a liner with registration slots on one side of the terminal marker 130 for printer registration.

As the terminal markers 130 move through the printer, the terminal markers 130 compress with the legs 140 folding up as the terminal marker 130 enters the gap 152 between the nip roller 150 and the print head 154. As a result, the terminal markers 130 of FIGS. 9A-C and 10 reduce production costs in the development and processing of the terminal markers 130 because compressing the terminal markers onto a liner and delivering the product to the customer in the compressed state is not necessary.

Figure 14A:
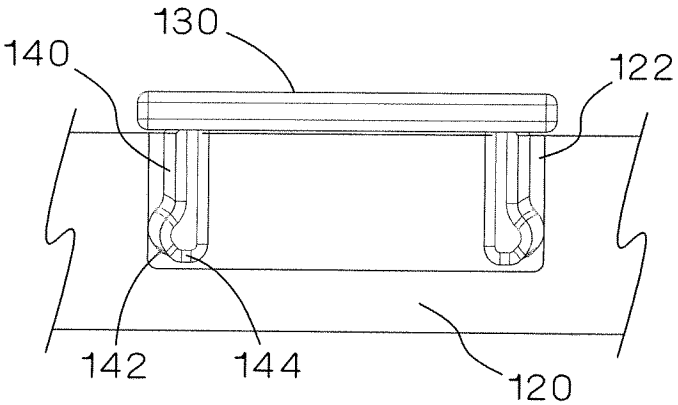
FIG. 14A is a front view of the terminal marker of FIG. 14 installed in the terminal block.
Figure 14:
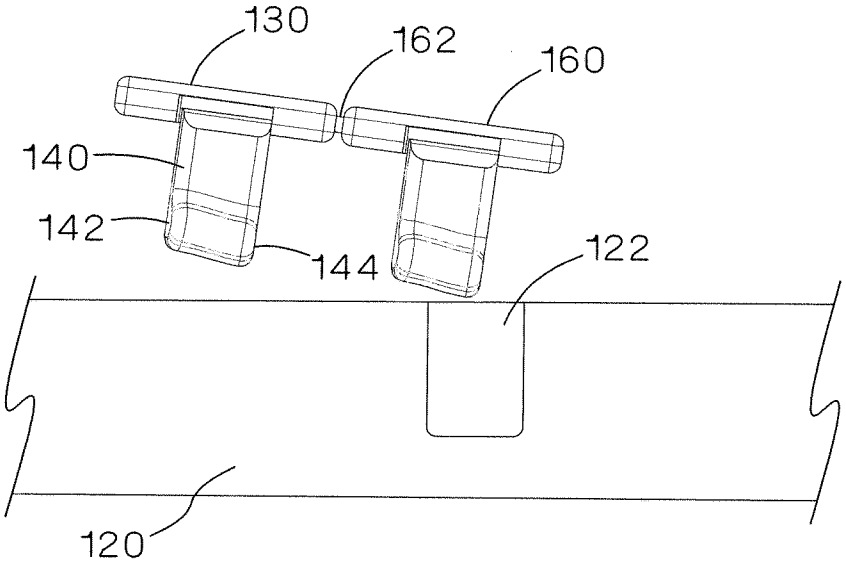
FIG. 14 is a side view of the terminal marker of FIG. 9A positioned to be installed in a terminal block.
Figure 15:
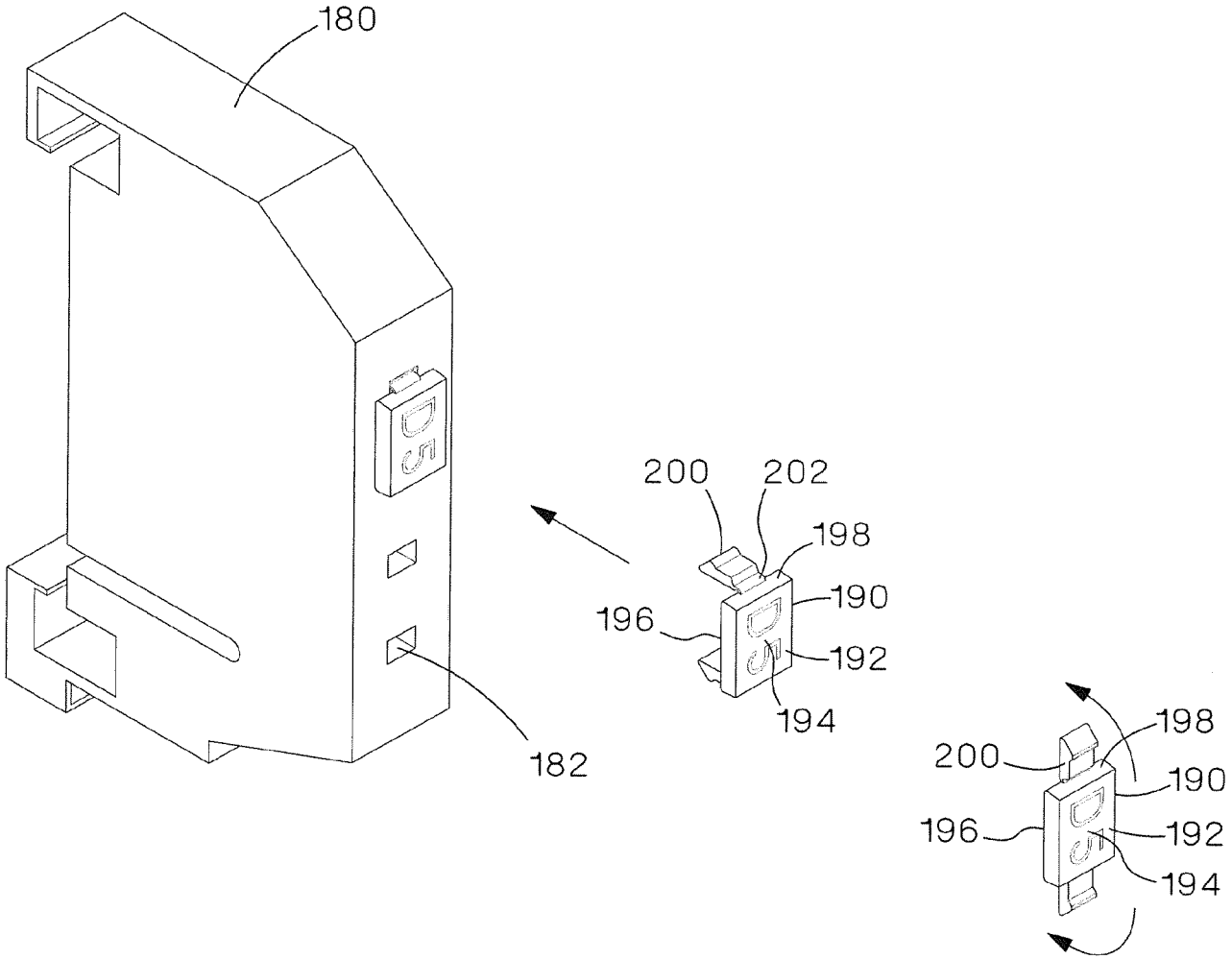
FIG. 15 is an exploded perspective view of an alternative terminal marker positioned to be installed in a terminal block.
Figure 16:
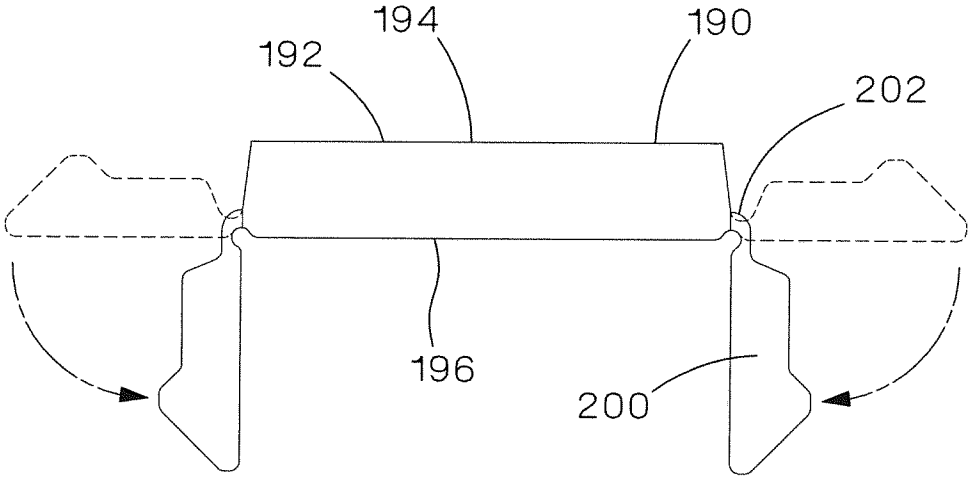
FIG. 16 is a front view of the terminal marker of FIG. 15 with legs attached via a living hinge.

FIG. 14 illustrates the terminal marker 130 positioned to be installed in the terminal block 120 and FIG. 14A illustrates the terminal marker 130 installed in the terminal block 120. Installation of the terminal marker 130 is best achieved by angling the back 144 of the leg 140 down slightly during insertion. The rotated legs 140 of the terminal marker 130 ensures that the back 144 of the leg 140 inserts easily into the terminal block opening 122 and guides the front 142 of the leg 140 into the opening 122 in one solid motion. As a result, the front 142 of the legs 140 slide into the opening 122 and snap into place.

As illustrated in FIG. 14A, when the terminal marker 130 is installed into the terminal block 120, the protruded front 142 of leg 140 provides a natural spring resistance to hold the terminal marker 130 in place. The legs 140 are designed to protrude out beyond the wall of the terminal block opening 122. The walls of the terminal block opening 122 force the front 142 of the leg 140 to rotate in line with the back 144 of the leg 140. This will create a spring force that will secure the terminal marker 130 in the opening 122 and will improve resistance to vibration.

FIGS. 15-18 illustrate an alternative terminal marker 190 of the present invention. The terminal marker 190 includes a front 192 with a print surface 194, a back 196, sides 198 and legs 200 attached to the sides 198. The alternative terminal maker 190 is designed to be printed in a standard thermal transfer printer and mounted to a terminal block 180 using the latching method typical of other terminal block marking systems. The terminal marker 190 is produced and packaged in a flat format for printing thereby allowing compatibility with a standard printer. After printed, the legs 200 would be folded to be perpendicular with the front side print surface 194 on the front 192. The terminal marker 190 can then be inserted in the terminal block openings 182 of the terminal block 180.

The terminal marker 190 is extruded from a flexible plastic resin. The legs 200 are attached with a living hinge 202, (see FIG. 16), allowing the legs 200 to be folded for installation. The terminal marker 190 is notched to reduce the leg width for proper fit in the terminal block 180 while maintaining the common width of the print surface 194.

Figure 17:
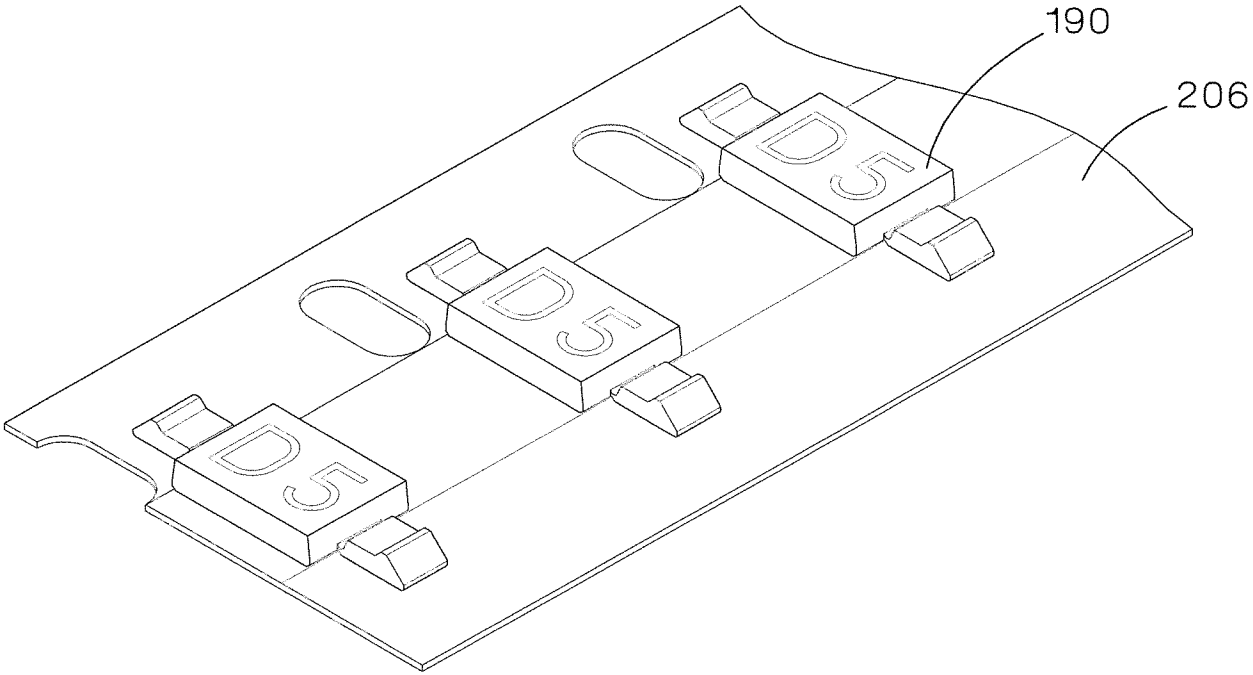
FIG. 17 is a top perspective view of the terminal marker of FIG. 15 attached to a liner.
Figure 18:
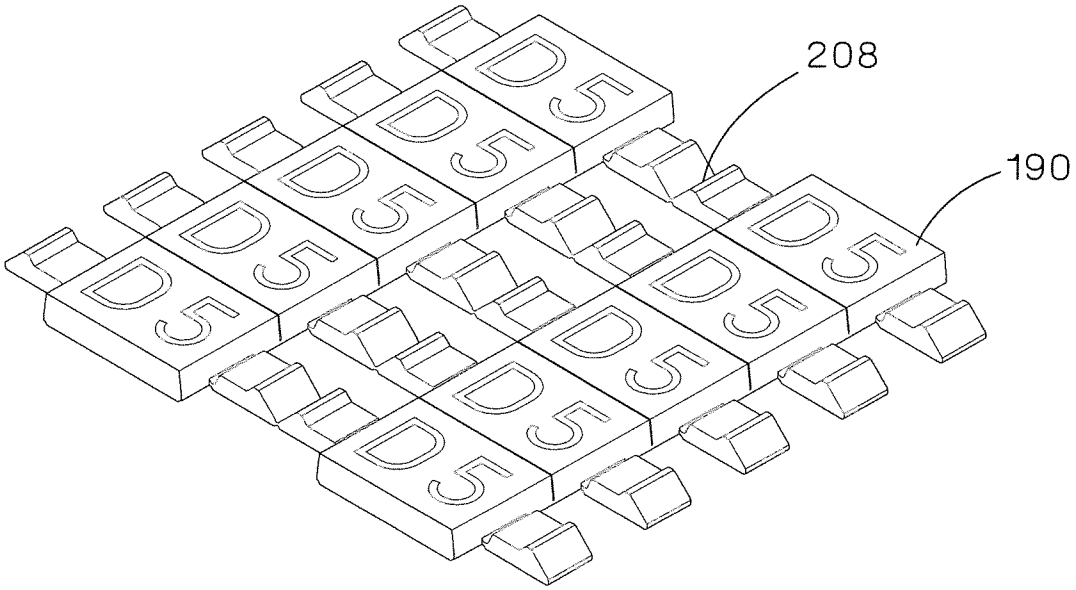
FIG. 18 is a top perspective view of the terminal marker of FIG. 15 in a multiple row format with each terminal marker separated by webbing.
Figure 19:
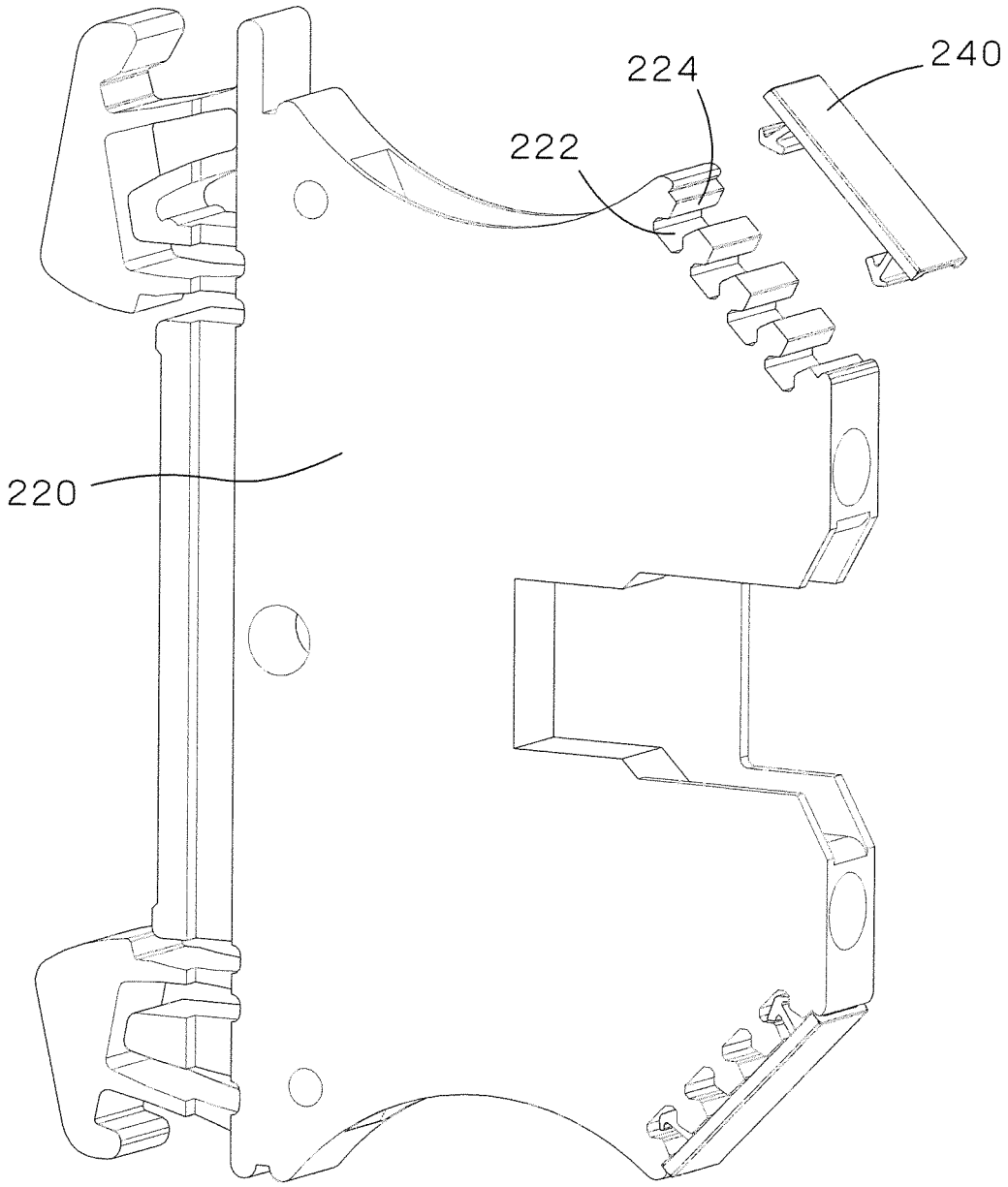
FIG. 19 is a perspective view of the terminal marker positioned to be installed in a terminal block.

The terminal markers 190 could be applied to a liner 206 for printing with cassette based or desktop printers (see FIG. 17). The terminal markers 190 could also be produced in multiple row format (see FIG. 18) with separable webbing 208 between the terminal markers 190 for optimum performance in desktop printers. After printing, the individual terminal markers 190 would be separated by tearing the webbing 208 holding them together. The printed terminal markers 190 would be ready to be installed in a terminal block 180.

FIGS. 19-26C illustrate a modification to the terminal markers described above with respect to FIGS. 2-18. The terminal marker 240 is designed to be installed in slots 222 in a terminal block 220. The terminal markers 240 are molded in an installable state with legs 260 extending downward. The terminal marker 240 is molded from a thermoplastic material that includes elastic properties to allow the legs 260 of the terminal marker 240 to bend and flex to accommodate the printing operation. Once the terminal marker 240 exits the printing operation, the legs 260 return to the installed or natural state without force or manipulation by the user.

Figure 20A:
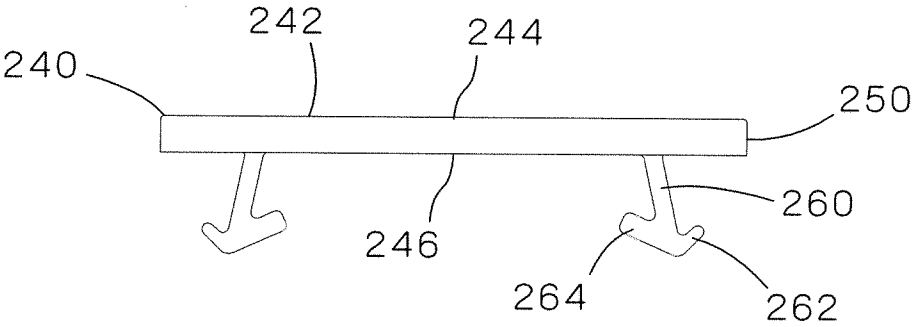
FIG. 20A is a front view of the terminal marker of FIG. 19 in an installed state.
Figure 20C:
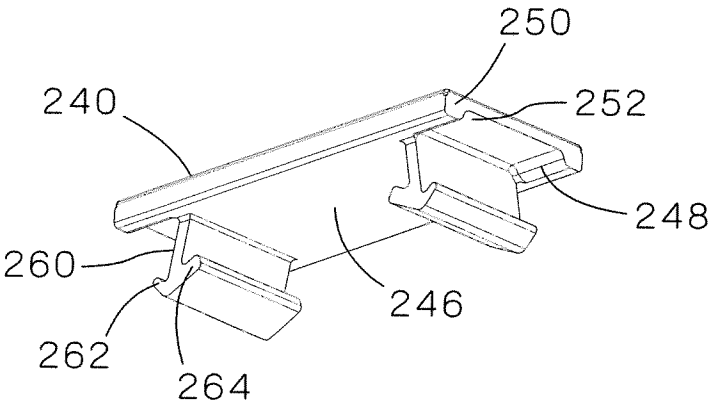
FIG. 20C is a bottom perspective view of the terminal marker of FIG. 20A.
Figure 20B:
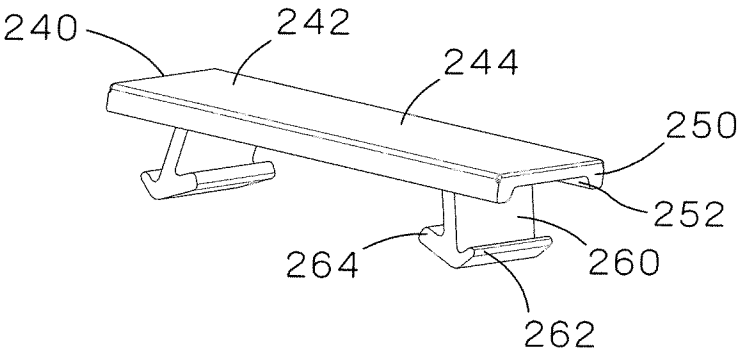
FIG. 20B is a top perspective view of the terminal marker of FIG. 20A.
Figure 21:
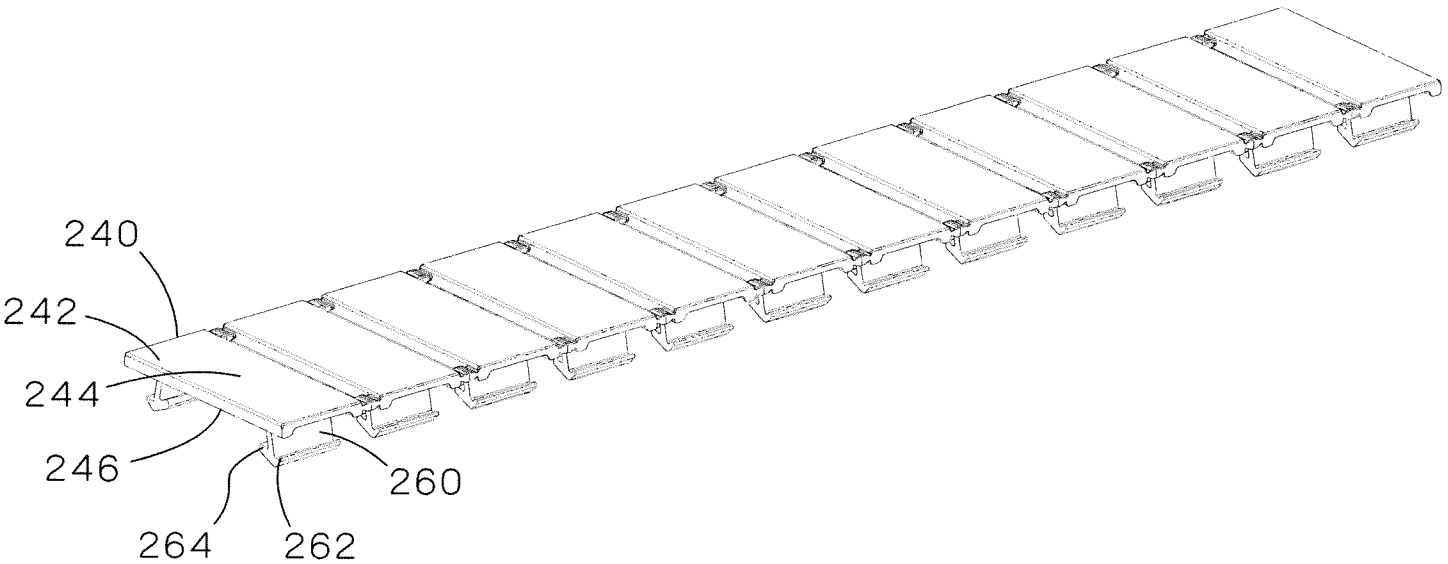
FIG. 21 is a top perspective view of a continuous strip of the terminal marker of FIG. 20A.

As illustrated in FIGS. 20A-20C, the terminal marker 240 includes a front 242 with a print surface 244, a back 246 having openings 248, and sides 250 having openings 252. Each terminal marker 240 includes two legs 260 that extend downward at an acute angle from the back 246 of the terminal marker 240. The angled legs 260 include outer hooks 262 and inner hooks 264 designed to engage the slot 222 in the terminal block 220. The outer hooks 262 extend outward and upwardly toward the sides or outer edge of the terminal marker 240. The inner hooks 264 extend inwardly toward a center of the terminal marker 240. As a result, the inner hook 264 of each leg 260 extends toward each other.

The angled legs 260 fold in a uniform manner as the terminal marker 240 advances through the printer (not illustrated). During the printing operation, the nip roller engages the increased surface area exposed on the interior of the leg 260 and naturally folds the leg 260 upward as it draws the terminal marker 240 into the printing operation to provide a thin flat surface that is necessary for printing.

Figure 22A:
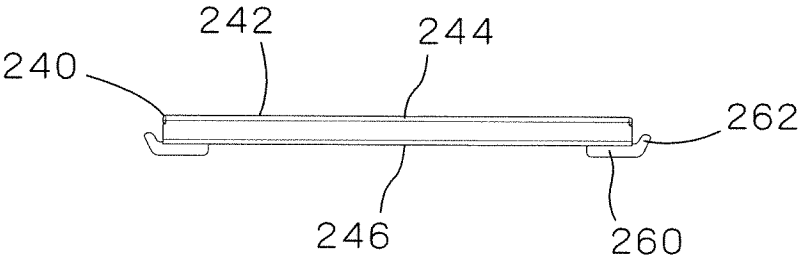
FIG. 22A is a front view of the terminal marker of FIG. 19 in a compressed state.
Figure 22C:
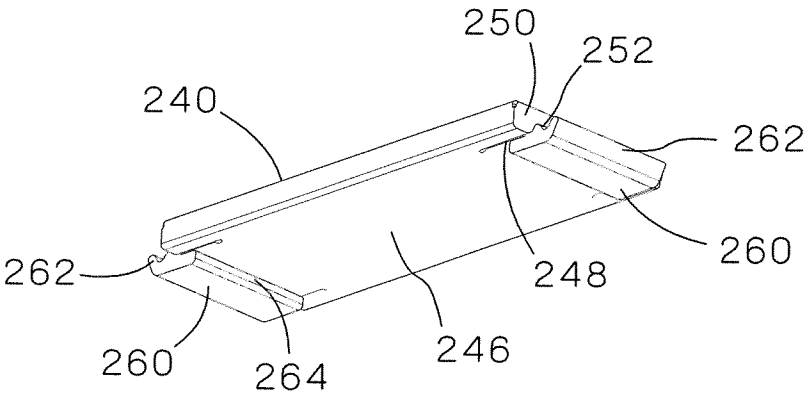
FIG. 22C is a bottom perspective view of the terminal marker of FIG. 22A.
Figure 22B:
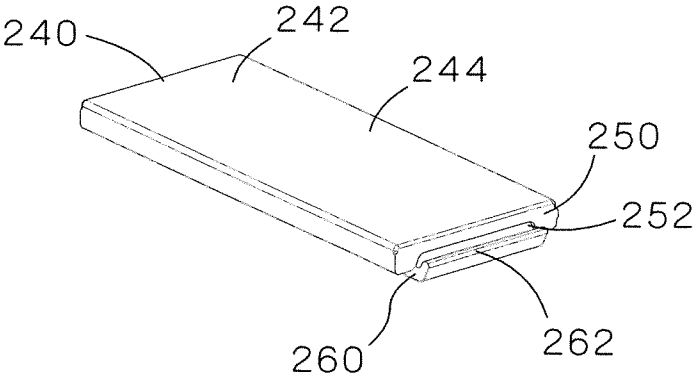
FIG. 22B is a top perspective view of the terminal marker of FIG. 22A.
Figure 23:
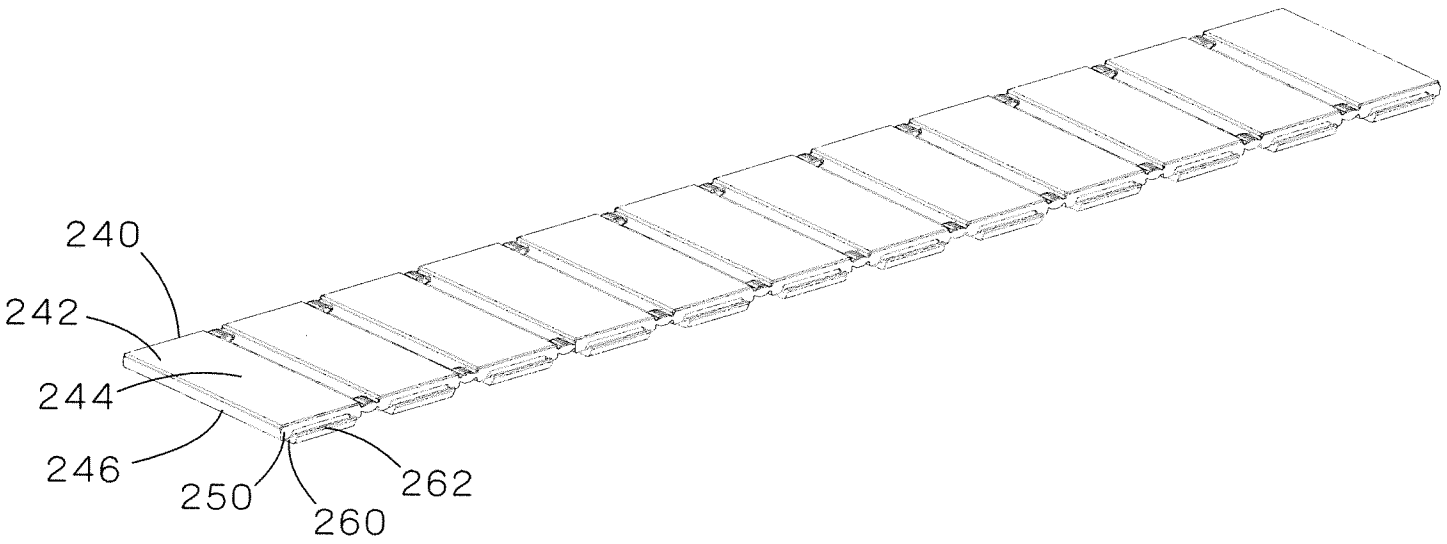
FIG. 23 a top perspective view of a continuous strip of the terminal marker of FIG. 22A.

FIGS. 22A-C and 23 illustrate the terminal marker 240 in a compressed position. As discussed above, the legs 260 of each terminal marker 240 fold upward when the terminal marker 240 is advanced through a printer. Thus, when the legs 260 fold upward, the hooks 262, 264 begin to flatten. As a result, the legs 260 are positioned in the openings 248 in the back 246 and the outer hooks 262 extend past the sides 250. As illustrated in FIG. 22C, the inner hooks 264 are flattened so that they are positioned on the folded legs 260.

Figure 24A:
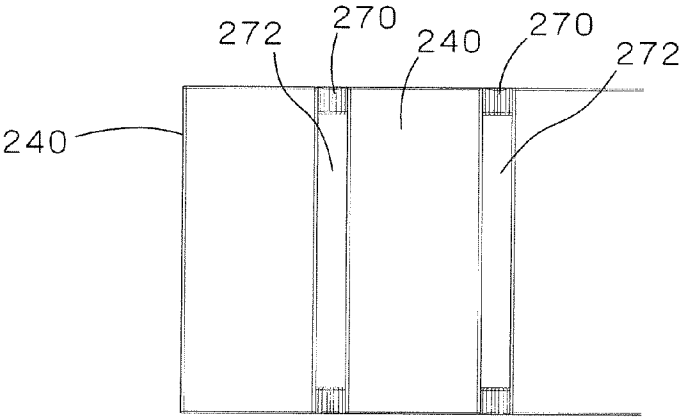
FIG. 24A is a top view of a continuous strip of the terminal markers of FIG. 21 connected by connecting beads.
Figure 24B:
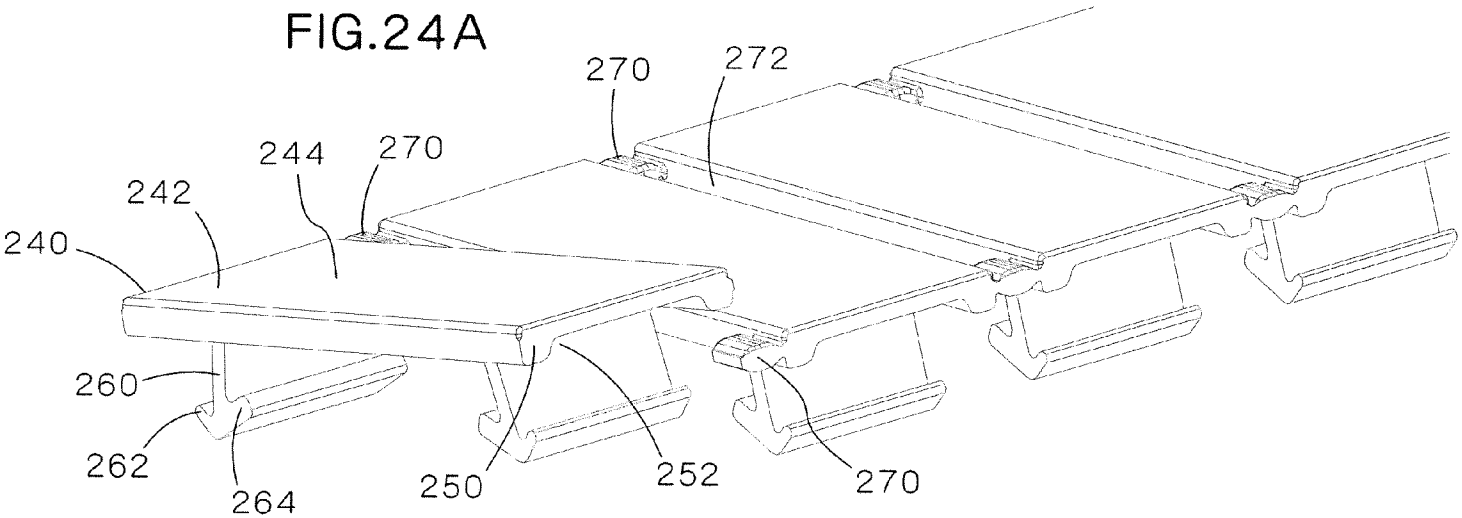
FIG. 24B is a perspective view of the continuous strip of FIG. 24A with a terminal marker partially torn away from a connecting bead.

The terminal marker is molded with perforations to allow for easy separation of the individual terminal markers 240 from each continuous strip, when necessary. As illustrated in FIGS. 24A-B, the terminal markers 240 in a continuous strip are separated by connecting beads 270. The connecting beads 270 are located at the edges of the terminal marker 240 to connect adjacent terminal markers 240 in the continuous strip. Additionally, the connecting beads 270 create a slot or opening 272 in the middle of the continuous strip between adjacent terminal markers 240 for the printer to sense. When the user wishes to remove a terminal marker 240 from the continuous strip, the end of the terminal marker 240 is moved upward in a vertical direction (see FIG. 24B) for an easy clean tear at an end of the connecting bead 270. The connecting beads 270 include thin cross sections to control the tear points in the continuous strip. As a result, the desired aesthetic appeal of the terminal marker 240 is maintained. Upon complete removal of the terminal marker, the connecting bead 270 may be disposed.

Figure 25A:
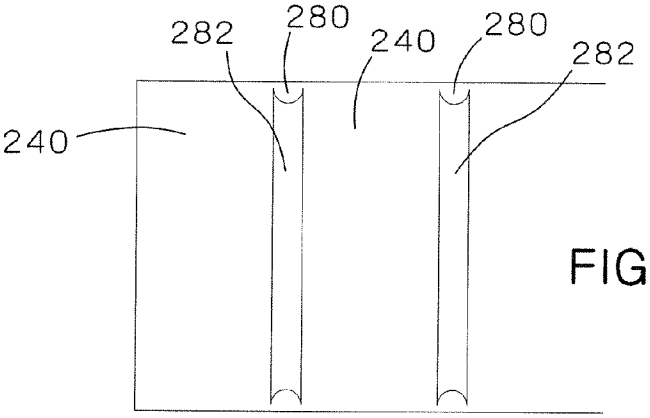
FIG. 25A is a top view of a continuous strip of the terminal markers of FIG. 20A connected by semi-circular projections.
Figure 25B:
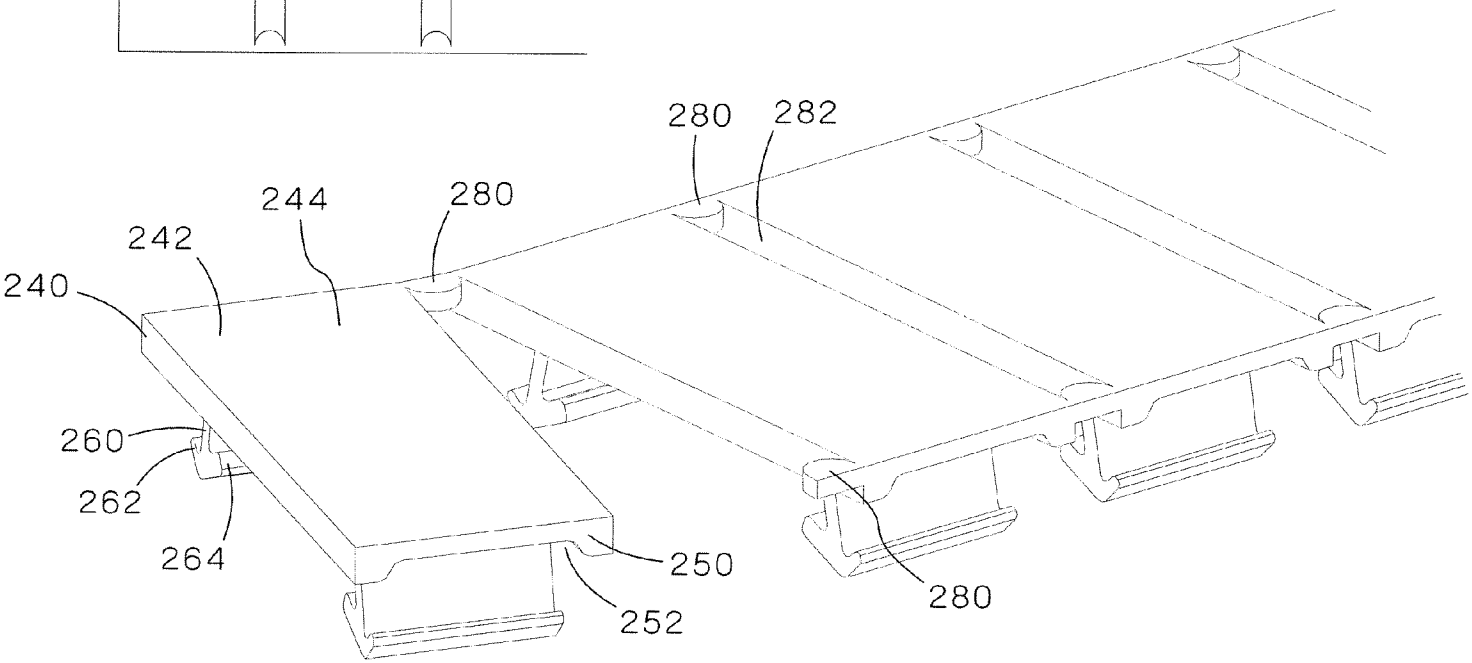
FIG. 25B is a perspective view of the continuous strip of FIG. 25A with a terminal marker partially torn away from the semi-circular projection.

As illustrated in FIGS. 25A-B, the terminal markers 240 in a continuous strip are separated by semi-circular projections 280. The semi-circular projections 280 are located at the edges of the terminal marker 240 to connect adjacent terminal markers 240 in the continuous strip. Additionally, the semi-circular projections 280 create a slot or opening 282 in the middle of the continuous strip between adjacent terminal markers 240 for the printer to sense. When the user wishes to remove a terminal marker 240 from the continuous strip, the end of the terminal marker 240 is moved outward in a horizontal direction (see FIG. 25B) for an easy clean tear at an end of the semi-circular projection 280. Upon complete removal of the terminal marker 240, the semi-circular projections 280 may be disposed.

Figures 26A, 26B, 26C:
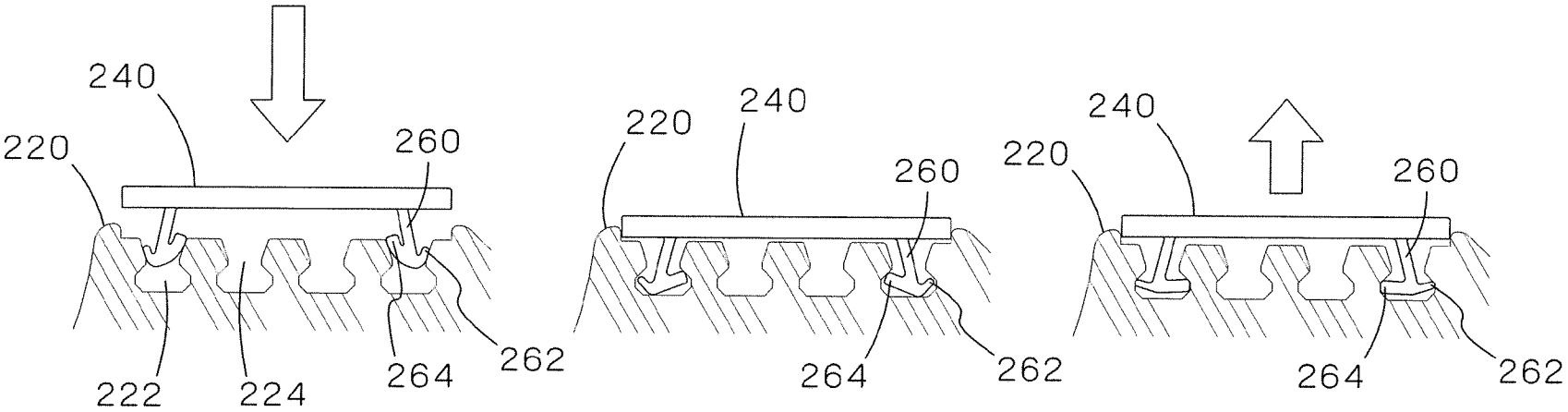
FIG. 26A is a front view of the terminal marker of FIG. 20A being installed in a slot of the terminal block.
FIG. 26B is a front view of the terminal marker of FIG. 20A installed in a slot of the terminal block.
FIG. 26C is a front view of the terminal marker of FIG. 20A trying to be removed from a slot in the terminal block.

FIGS. 26A-26C illustrate the terminal marker 240 being installed in a slot 222 in a terminal block 220. As the terminal marker 240 is installed, the walls at the narrow opening 224 of the slot 222 force the hooks 262, 264 of the legs 260 to compress (see FIG. 26A) until the legs 260 are fully inserted into the slot 222. As illustrated in FIG. 26B, once installed, the two hooks 262, 264 provide a natural spring resistance to hold the terminal marker 240 in place. As illustrated in FIG. 26C, if a user attempts to remove the terminal marker 240, the hooks 262, 264 are designed to flex back and provide resistance to maintain the terminal marker 240 in the slot 222.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

The invention claimed is:

1. A terminal marker for identifying a terminal block, the terminal marker comprising:

a front having a print surface, a back, sides and flexible legs, wherein each flexible leg has two hooks;

wherein the flexible legs are disposed in a natural state extending at an angle with respect to the print surface of the terminal marker for installation in the terminal block; and wherein the flexible legs are disposed in a compressed state folded into the back and parallel to the print surface for obtaining a marking from a printer.

2. The terminal marker on claim 1, wherein the two hooks include an outer hook extending toward one of the sides of the terminal marker and an inner hook extending toward a center of the terminal marker.

3. The terminal marker of claim 2, wherein the outer hook flattens to extend past the side of the terminal marker in the compressed state.

4. The terminal marker of claim 2, wherein the inner hook flattens and is disposed on the leg in the compressed state.

5. The terminal marker of claim 1, wherein the hooks compress toward the leg when installed in the terminal block.

6. The terminal marker of claim 1, wherein the hooks extend away from the leg to resist removal from the terminal block.

7. A continuous strip of terminal markers for identifying a terminal block, the continuous strip of terminal markers comprising:

a plurality of terminal markers, each terminal marker having a front with a print surface, a back, sides, and flexible legs having two hooks; wherein the flexible legs are disposed in a natural state extending at an angle with respect to the print surface of the terminal marker for installation in the terminal block; and wherein the flexible legs are disposed in a compressed state folded into the back and parallel to the print surface for obtaining a marking from a printer; and a tear off projection positioned at the sides of adjacent terminal markers.

8. The continuous strip of terminal markers of claim 7, wherein the tear off projection is a connecting bead.

9. The continuous strip of terminal markers of claim 8, wherein the terminal marker is torn in a vertical direction to remove the terminal marker from the connecting bead.

10. The continuous strip of terminal markers of claim 7, wherein the tear off projection is a semi-circular projection.

11. The continuous strip of terminal markers of claim 10, wherein the terminal marker is torn in a horizontal direction to remove the terminal marker from the semi-circular projection.

* * * * *